US007444840B2

(12) United States Patent
Jackson et al.

(10) Patent No.: US 7,444,840 B2
(45) Date of Patent: Nov. 4, 2008

(54) AIR CIRCULATION SYSTEM IN A CLOTHES REFRESHER

(75) Inventors: Floyd G. Jackson, Baroda, MI (US); James C. Perso, St. Joseph, MI (US); Robert J. Pinkowski, Baroda, MI (US); Viktor N. Kopyrin, Dearborn, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 540 days.

(21) Appl. No.: 10/249,601

(22) Filed: Apr. 23, 2003

(65) Prior Publication Data

US 2004/0211227 A1 Oct. 28, 2004

(51) Int. Cl.
*B08B 3/12* (2006.01)

(52) U.S. Cl. ..... 68/5 C; 68/6; 68/12.27; 68/70; 68/100; 68/222; 8/158

(58) Field of Classification Search ..... 68/12.27, 68/222, 5 C, 6, 70; 8/158
See application file for complete search history.

(56) References Cited

U.S. PATENT DOCUMENTS

| | | | | |
|---|---|---|---|---|
| 1,525,649 | A * | 2/1925 | Ilg | 415/146 |
| 2,434,476 | A * | 1/1948 | Wales | 68/19.2 |
| 3,670,425 | A | 6/1972 | Benjamin et al. | 34/46 |
| 3,752,373 | A * | 8/1973 | Smith | 223/51 |
| 3,869,815 | A | 3/1975 | Bullock | 38/776 |
| 5,619,612 | A * | 4/1997 | Glucksman et al. | 392/360 |
| 6,189,346 | B1 * | 2/2001 | Chen et al. | 68/5 R |
| 6,840,068 | B2 * | 1/2005 | Pasin et al. | 68/5 C |
| 2003/0126691 | A1 * | 7/2003 | Gerlach et al. | 8/158 |

FOREIGN PATENT DOCUMENTS

| | | | |
|---|---|---|---|
| DE | 2646 903 | | 4/1978 |
| EP | 1182292 | | 2/2002 |
| GB | 2307399 | | 5/1997 |
| GB | 2307399 | A * | 5/1997 |

* cited by examiner

*Primary Examiner*—Michael Barr
*Assistant Examiner*—Rita R Patel
(74) *Attorney, Agent, or Firm*—Clifton Green; Michael D. Lafrenz

(57) ABSTRACT

A garment refreshing appliance comprising: an enclosure for receiving at least one garment to be refreshed, a support positioned in said enclosure to receive and suspend said garment in said enclosure, an air moving device arranged to circulate a flow of air within said enclosure, and an air duct associated with said air moving device to direct said circulating flow of air within said enclosure, said air duct having a plurality of flow directing vanes associated therewith to direct said recirculating flow of air against said garment.

15 Claims, 3 Drawing Sheets

AIR CIRCULATION SYSTEM IN A CLOTHES REFRESHER

BACKGROUND OF INVENTION

The present invention relates to garment treating apparatus and more particularly to an apparatus for cleaning, deodorizing and de-wrinkling garments in the presence of an air flow.

The prior art provides various devices for use in cleaning, deodorizing and de-wrinkling garments or clothes items which are preferably not washed using conventional full water immersion wash processes. Past efforts have focused on clothes treating enclosures and apparatus which are designed to clean and refresh garments by employing an air stream, which may be heated, and including other air borne additives such as steam or a conditioning fluid. For example, U.S. Pat. No. 3,752,373 discloses a portable wardrobe refresher utilizing a clothes transporting bag having flexible walls as the enclosure. An arrangement is provided for circulating steam or hot air throughout the enclosure.

U.S. Pat. No. 6,189,346 discloses a clothes treating apparatus in which air is recirculated within the enclosure and over the clothes and a conditioning fluid is dispensed into the air stream.

U.S. Pat. No. 3,869,815 discloses a garment finishing apparatus in which a blower is used to recirculate a flow of air within a cabinet and vent hole is provided in the blower outlet side of the motor to allow a portion, e.g., 10%, of the air entering the blower inlet to exhaust to the atmosphere to facilitate removal of moisture from the cabinet interior. Cracks in the cabinet due to the imperfect sealing of the door with the cabinet opening permit make-up air to enter the cabinet interior to avoid creation of a significant vacuum in the cabinet interior.

SUMMARY OF INVENTION

The present invention provides a garment refreshing apparatus with an enclosure for receiving at least one garment to be refreshed and a support positioned within the enclosure to receive and suspend the garment in the enclosure. An air moving device is arranged to re-circulate a flow of air within the enclosure and an exhaust outlet is provided for exhausting a portion of the recirculating flow of air from within the enclosure. A replacement air inlet admits replacement air into the enclosure and a filter positioned in association with the exhaust outlet traps and contains malodors from that portion of the recirculating flow of air exiting through the exhaust outlet. In this manner, only deodorized air is exhausted from the enclosure.

In an embodiment of the invention, a garment refreshing appliance is provided which comprises an enclosure with flexible walls for receiving a garment to be refreshed and a support positioned in the enclosure to receive and suspend the garment in the enclosure. An air moving device is arranged to recirculate a flow of air within the enclosure and an exhaust outlet is provided for exhausting a portion of the recirculating flow of air from within the enclosure. A replenishment air inlet admits replacement air into the enclosure, wherein an opening size of the replacement air inlet, an opening size of the exhaust outlet, and a speed and air flow capacity of the air moving device are controlled to achieve a slightly higher than ambient pressure inside of the enclosure causing the flexible walls to bulge outwardly.

In an embodiment of the invention, a garment refreshing appliance is provided which comprises an enclosure for receiving a garment to be refreshed, a support is positioned in the enclosure to receive and suspend the garment in the enclosure. An air moving device is arranged to circulate a flow of air within the enclosure and an air duct is associated with the air moving device to direct the circulating flow of air within the enclosure, the air duct having a plurality of flow directing vanes associated therewith to direct the circulating flow of air against the garment and away from the enclosure walls.

DETAILED DESCRIPTION

Figure 1:
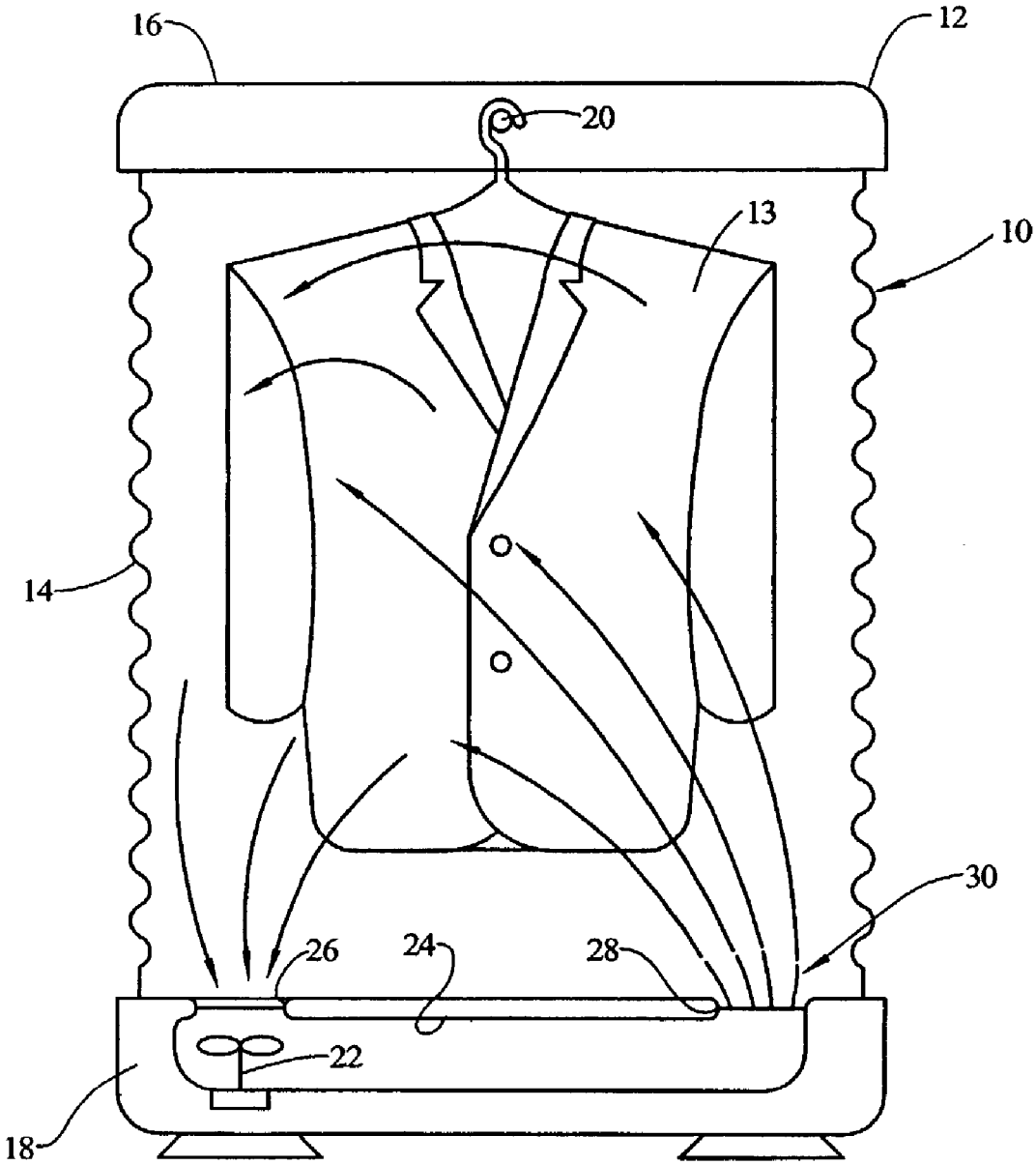
FIG. 1 is a schematic side sectional view showing the interior of a clothes refreshing device embodying the principles of the present invention.

In FIG. 1 there is illustrated a garment refreshing appliance 10 shown schematically in cross section in which there is an enclosure 12 for receiving at least one garment 13 to be refreshed. The enclosure 12 can embody a variety of different configurations, and in the configuration illustrated in FIG. 1, the enclosure has sidewalls 14 which, in some embodiments, may comprise partially or completely flexible yet substantially fluid impervious walls. The term flexible walls as used herein and in the claims shall mean at least one wall having at least a portion thereof which is flexible. A solid top 16 and solid base 18 complete the enclosure. One of the walls 14 should include an openable aperture, such as a door or slit, which may be hinged or zippered, to provide access to the interior of the enclosure 12.

A support 20 is positioned in the enclosure 12 to receive and suspend the garment 13 in the enclosure. An air moving device 22, which may be in the form of a fan or blower, is arranged to circulate a flow of air in contact with the garment within the enclosure 12 to remove malodors from the garment. The placement of the air moving device 22 can be varied relative to the interior of the enclosure 12, but in the embodiment illustrated in FIG. 1, the air moving device is located in the base 18 and within an air flow duct 24 such that air is drawn into an inlet opening 26 of the duct and is exhausted through an outlet opening 28 of the duct. A plurality of flow directing vanes 30 (FIGS. 1, 3-5), 31 (FIGS. 3-5) are provided at the outlet 28 to direct the circulating flow of air against the garment 14.

In an embodiment, as illustrated, the air within the enclosure 12 may be recirculated by the air moving device 22, a continuous supply of fresh air may be directed against the garment and then exhausted or a combination of recirculation and fresh air may be directed against the garment.

Preferably the guide vanes 30, 31 are arranged at various angles relative to each other toward the garment 13 to spread the flow of air more evenly around the garment and away from the inside wall 14 of the enclosure 12. The angles of the vanes 30, 31 may be selected as a function of the air velocity and may be arranged to vary as an air flow speed through the duct 24 varies. For example, the vanes 30, 31 may be hinged and weighted such that the flow of air itself changes the angle of the vanes. Also, the position of the vanes 30, 31 may be controlled, such as by a motor operated crank, to change position dependent upon a speed of the air moving device 22.

Figure 4:
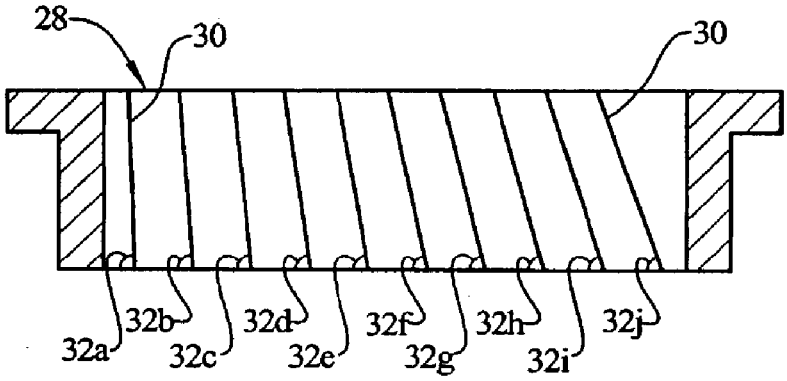
FIG. 4 is a side sectional view of the air outlet taken generally along the line IV-IV of FIG. 3.

In an embodiment, a plurality of vanes 30 extend across the front to rear dimension of the outlet 28. As shown in FIG. 4, the angles 32*a*-32*j* vary to direct an air flow against the garment 13. For example, in the embodiment illustrated, 10 vanes 30 are positioned in the opening with a leftmost vane being positioned at an angle 32*a* closest to 90° of all of the vanes, but slightly less than 90°. Thus, this vane will direct the airflow upwards and slightly to the left. The rightmost vane is positioned at an angle 32*j* which is the smallest and hence furthest away from 90°. This vane, therefore, will direct the airflow upwards and with a greater leftward vector. The intermediate vanes are positioned at angles 32*b*-32I which progressively decrease to the right.

Figure 5:
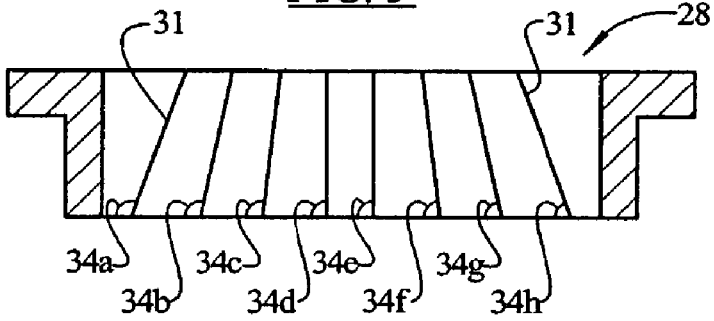
FIG. 5 is a side sectional view of the air outlet taken generally along the line V-V of FIG. 3.

The second plurality of vanes 31 may be provided which extend across the left to right dimension of the outlet opening 28. As shown in FIG. 5, the angles 34*a*-34 vary to direct an air flow against the garment 13. In the embodiment illustrated, the angles 34*d* and 34*e* of the central vanes are approximately 90° while the angles 34*a* and 34*h* of the outermost vanes may vary more from perpendicular.

Various fluid treatments may be dispensed into the interior of the enclosure in a manner such as taught in U.S. Pat. No. 6,189,346, the disclosure of which is incorporated herein by reference.

Figure 2:
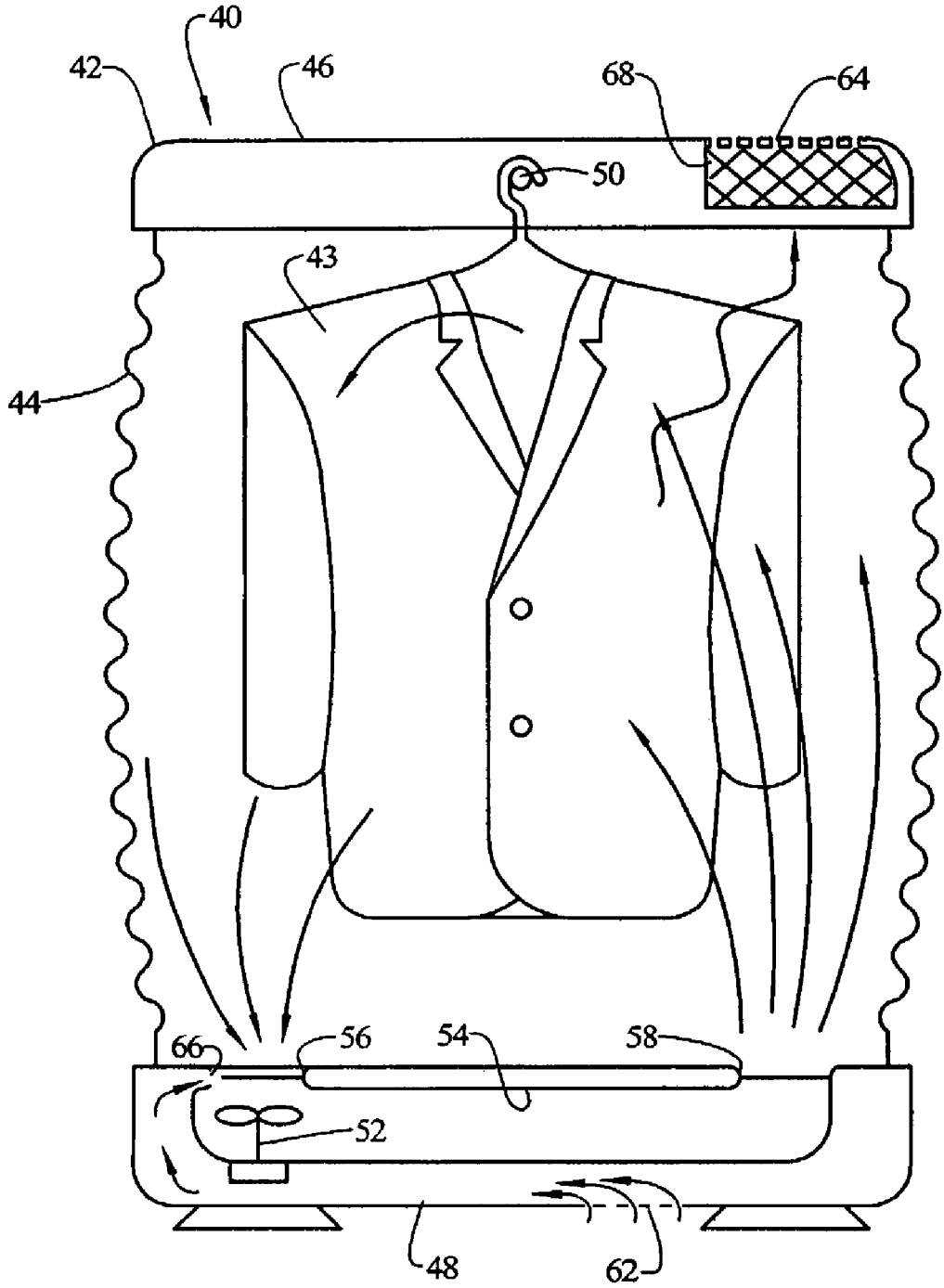
FIG. 2 is a schematic side sectional view showing the interior of another embodiment of a clothes refreshing device embodying the principles of the present invention.

In FIG. 2, another embodiment of a garment refreshing appliance is illustrated at 40 which also may be arranged in a variety of configurations. In the configuration illustrated, the appliance 40 includes an enclosure 42 which has a plurality of walls 44, a top 46 and a base 48. As described above, parts or all of one or more of the walls 44 may be made of a flexible yet fluid impermeable material.

A support 50 is positioned in the enclosure 42 to receive and suspend a garment 43. An air moving device 52 is arranged to circulate a flow of air within the enclosure 42. Although the air moving device 52 can be arranged in a variety of locations, in the embodiment illustrated, the air moving device comprises a fan located in an air duct 54 which in turn is located in the base 48. The air duct 54 has an inlet opening 56 and an air outlet opening 58. The enclosure 42 has one or more inlet vents 62 and one or more outlet vents 64 and the air duct 54 also has a replenishment air inlet 66. The replenishment air inlet 66 is sized to control the rate of air replenishment (which is a function of a speed of the air moving device 52). This air inlet 66 is located in a low pressure zone near the inlet 56 of the duct 54. As the air volume inside the enclosure 42 circulates through the air moving device 52, the controlled volume of fresh replenishment air mixes with the air inside the enclosure. As replenishment air comes in, it creates a slightly higher pressure inside the enclosure 42 than on the outside of the enclosure. This slight pressure increase causes air to flow through the exhaust outlet 64. In the preferred embodiment, replenishment is controlled to achieve a replacement rate of approximately 3-7% such that most of the air will recirculate within the enclosure 42. If desired, a higher replacement rate can be selected, however, if fluid conditioners are being dispensed to the interior of the enclosure 42, then a higher rate of replacement will expel a greater amount of the conditioning fluid.

In an embodiment where a portion of or all of the walls 44 are made of a flexible material, an opening size of the replenishment air inlet 66, an opening size of the exhaust outlet 64 and a speed and air flow capacity of the air moving device 52 can be controlled to achieve a slightly higher than ambient pressure inside of the enclosure 42 causing the flexible walls 44 to bulge outwardly as shown in FIG. 2. This allows the walls to move away from the garment 43 to provide an increased clearance between the walls 44 of the enclosure 42 and the garment allowing better air flow around the garment and increasing the effectiveness of the appliance 40. Also, the increased clearance between the enclosure 42 and the garment 43 reduces the possibility of condensed moisture on the enclosure walls 44 from being transferred to the garment which may leave spots on the garment. Further, if the enclosure walls 44 are flexible, they may be subject to some wrinkling and when they bulge outwardly, the wrinkles will be stretched out creating a more pleasing appearance of the enclosure.

As also illustrated in FIG. 2, a filter 68 may be positioned in association with the exhaust outlet 64 for trapping and containing malodors which have been released from the garment, the malodors being separated from that portion of the circulating flow of air which exits through the exhaust outlet 64. In an embodiment of the invention, the filter comprises a low pressure drop filter.

Figure 3:
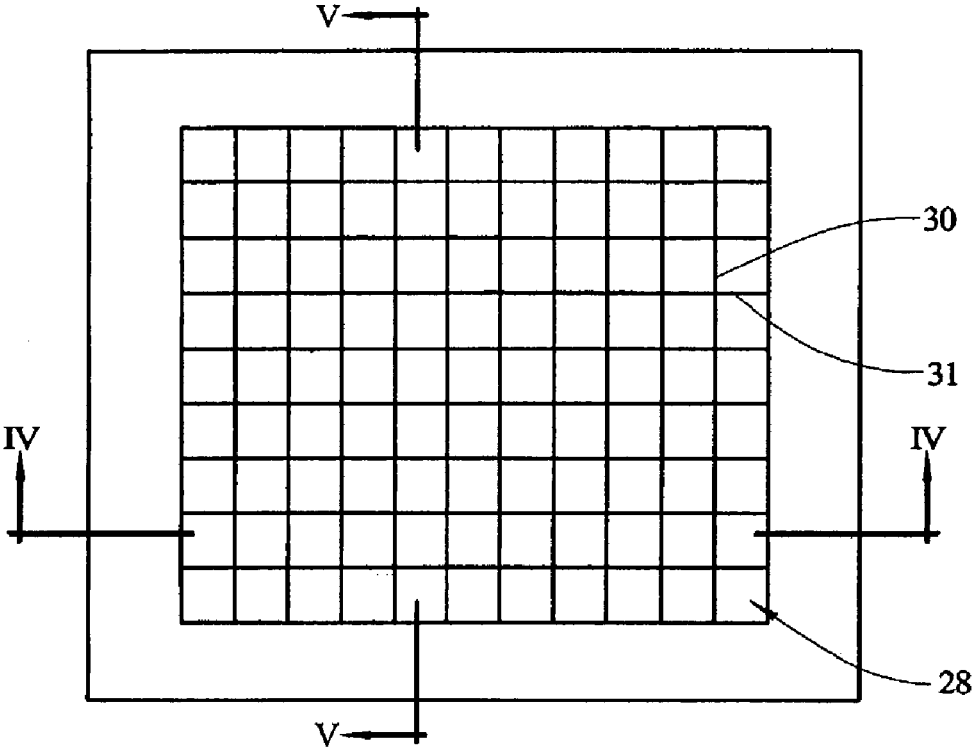
FIG. 3 is a plan view of an interior air outlet used in an embodiment of the clothes refreshing device of FIG. 1.

The vanes 30 illustrated in FIGS. 1 and 3-5 and 31 illustrated in FIGS. 3-5 could also be utilized in the embodiment of FIG. 2, that is, flow directing vanes can be utilized in an arrangement where a pressurized enclosure with flexible walls has a circulating air flow flowing therethrough with replenishment air and exhausting air being admitted to and departing from the enclosure. The vanes 30, 31 can also be utilized in an embodiment in which a filter is utilized to remove malodors from the air exiting the enclosure.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The invention claimed is:

1. A garment refreshing appliance comprising:

an enclosure for receiving at least one garment to be refreshed, a support positioned in the enclosure to receive and suspend the garment in the enclosure, an air moving device arranged to circulate a flow of air within the enclosure, an exhaust outlet arranged to exhaust a portion of the circulating flow of air from within the enclosure during operation of the air moving device, a replenishment air inlet, spaced from the exhaust outlet communicating with an exterior of the enclosure and arranged to admit replacement air into the enclosure during operation of the air moving device, an air duct associated with the air moving device to direct the circulating flow of air within the enclosure, the air duct having a plurality of flow directing vanes associated therewith to direct the recirculating flow of air against the garment, the plurality of vanes being movably mounted relative to the air duct such that a velocity of the air moving past the vanes controls an angle of the vanes relative to the air duct and wherein the plurality of vanes are arranged at varying angles relative to each other, and a low pressure drop filter positioned across the exhaust outlet for trapping and containing malodors from that portion of the recirculating flow of air exiting through the exhaust outlet.

2. The garment refreshing appliance of claim 1, wherein an opening size of the replenishment air inlet is controlled to achieve a replacement rate of approximately 3-7%.

3. The garment refreshing appliance of claim 1, wherein the enclosure has at least one flexible portion of at least one wall and an opening size of the replenishment air inlet, an opening size of the exhaust outlet, and a speed and air flow capacity of the air moving device are controlled to achieve a slightly higher than ambient pressure inside of the enclosure causing the flexible wall portion to bulge outwardly.

4. A garment refreshing appliance of claim 1, wherein the vanes are mounted by means of hinges.

5. A garment refreshing appliance of claim 1, wherein the plurality of vanes includes a plurality of vanes arranged substantially perpendicular to each other.

6. A garment refreshing appliance comprising:

an enclosure having flexible walls for receiving at least one garment to be refreshed, a support positioned in the enclosure to receive and suspend the garment in the enclosure, an air moving device having a defined speed and air flow capacity arranged to circulate a flow of air in contact with the garment within the enclosure, an exhaust outlet having a defined size arranged to exhaust at least a portion of the circulating flow of air from within the enclosure during operation of the air moving device, a replenishment air inlet having a defined size, spaced from the exhaust outlet and arranged to admit replacement air into the enclosure during operation of the air moving device, a filter having a defined porosity positioned across the exhaust outlet for trapping and containing malodors from that portion of the circulating flow of air exiting through the exhaust outlet, the defined opening size of the replenishment air inlet, the defined opening size of the exhaust outlet, the defined porosity of the filter, and the defined speed and air flow capacity of the air moving device each being selected such that a slightly higher than ambient pressure will result inside of the enclosure when the air moving device is operated, such that the flexible walls of the enclosure will bulge outwardly.

7. The garment refreshing appliance of claim 6, wherein the filter comprises a low pressure drop filter.

8. The garment refreshing appliance of claim 6, wherein the opening size of the replenishment air inlet is and the speed and air flow capacity of the air moving device are selected to achieve a replacement rate of approximately 3-7%.

9. The garment refreshing appliance of claim 6, including an air duct associated with the air moving device to direct the circulating flow of air within the enclosure, the air duct having a plurality of flow directing vanes associated therewith to direct the circulating flow of air against the garment.

10. The garment refreshing appliance of claim 9, wherein the plurality of vanes are arranged at varying angles relative to each other.

11. A garment refreshing appliance of claim 9, wherein the plurality of vanes includes a plurality of vanes arranged substantially perpendicular to each other.

12. A garment refreshing appliance of claim 9, wherein the vanes are mounted by means of hinges.

13. A garment refreshing appliance comprising:

an enclosure for receiving at least one garment to be refreshed, a support positioned in the enclosure to receive and suspend the garment in the enclosure, an air moving device arranged to circulate a flow of air within the enclosure, and an air duct associated with the air moving device to direct the circulating flow of air within the enclosure, the air duct having an inlet, an outlet and a plurality of flow directing vanes arranged mounted by means of hinges at the outlet to direct the recirculating flow of air against the garment, the plurality of vanes being movably mounted relative to the air duct such that a velocity of the air moving past the vanes controls an angle of the vanes relative to the air duct, wherein the plurality of vanes are arranged at varying angles relative to each other, and wherein the air moving device has a defined speed and air flow capacity arranged to circulate a flow of air in contact with the garment within the enclosure, the enclosure comprises flexible walls, an exhaust outlet with a defined size arranged to exhaust at least a portion of the circulating flow of air from within the enclosure during operation of the air moving device, a replenishment air inlet with a defined size, spaced from the exhaust outlet and arranged to admit replacement air into the enclosure during operation of the air moving device, and a filter having a defined porosity positioned across the exhaust outlet for trapping and containing malodors from that portion of the circulating flow of air exiting through the exhaust outlet, wherein the defined opening size of the replenishment air inlet, the defined opening size of the exhaust outlet, the porosity of the filter, and the defined speed and air flow capacity of the air moving device each being selected such that a slightly higher than ambient pressure and a replacement rate of approximately 3-7% will result inside of the enclosure when the air moving device is operated, such that the flexible walls of the enclosure will bulge outwardly.

14. The garment refreshing appliance of claim 13, wherein the filter comprises a low pressure drop filter.

15. A garment refreshing appliance of claim 13, wherein the plurality of vanes includes a plurality of vanes arranged substantially perpendicular to each other.

* * * * *